US008931890B2

(12) United States Patent
Law et al.

(10) Patent No.: US 8,931,890 B2
(45) Date of Patent: Jan. 13, 2015

(54) METHOD AND APPARATUS FOR LEVELING A PRINTED IMAGE AND PREVENTING IMAGE OFFSET

(75) Inventors: Kock-Yee Law, Penfield, NY (US); Hong Zhao, Webster, NY (US); Paul McConville, Webster, NY (US); Bryan Roof, Newark, NY (US)

(73) Assignee: Xerox Corporation, Norwalk, CT (US)

( * ) Notice: Subject to any disclaimer, the term of this patent is extended or adjusted under 35 U.S.C. 154(b) by 166 days.

(21) Appl. No.: 13/524,656

(22) Filed: Jun. 15, 2012

(65) Prior Publication Data

US 2013/0333582 A1 Dec. 19, 2013

(51) Int. Cl.
*B41K 1/44* (2006.01)

(52) U.S. Cl.
USPC ..... 347/101; 347/103; 347/104; 101/335

(58) Field of Classification Search
CPC ..... B41J 2/2114; B41J 11/0015; B41J 2/01; B41M 5/52; B41M 7/00
See application file for complete search history.

(56) References Cited

U.S. PATENT DOCUMENTS

| | | | | |
|---|---|---|---|---|
| 6,648,467 | B1 * | 11/2003 | Pan et al. | 347/103 |
| 2011/0045186 | A1 | 2/2011 | Gervasi et al. | |
| 2011/0157278 | A1 * | 6/2011 | Gulvin et al. | 347/45 |
| 2011/0304674 | A1 * | 12/2011 | Sambhy et al. | 347/84 |
| 2013/0002770 | A1 * | 1/2013 | Roof et al. | 347/84 |

OTHER PUBLICATIONS

U.S. Appl. No. 13/173,492; Roof et al., filed Jun. 30, 2011; "Methods for UV Gel Ink Leveling and Direct-To-Substrate Digital Radiation Curable Gel Ink Printing, Apparatus and Systems Having Leveling Member With a Metal Oxide Surface".

* cited by examiner

*Primary Examiner* — Manish S Shah
*Assistant Examiner* — Jeremy Delozier
(74) *Attorney, Agent, or Firm* — Ronald E. Prass, Jr.; Prass LLP

(57) ABSTRACT

An approach is provided for contact leveling an image applied to a media substrate. The approach involves causing, at least in part, a contact leveling member comprising at least one textured surface configured to repel one or more inks to level an image applied to the media substrate. The at least one textured surface may comprise one or more micro/nano structures configured to cause, at least in part, the at least one textured surface to have an ink contact angle greater than 100° and a sliding angle less than 30° when the at least one textured surface contacts the one or more inks.

11 Claims, 6 Drawing Sheets

METHOD AND APPARATUS FOR LEVELING A PRINTED IMAGE AND PREVENTING IMAGE OFFSET

FIELD OF DISCLOSURE

The disclosure relates to a method and apparatus for leveling a printed image to prevent image defects in a finished print product while preventing offset of the printed image to any leveling or fuser member.

BACKGROUND

Conventional drop ejector printing processes that apply ultraviolet (UV) curable gel inks often result in various image related defects such as, but not limited to, lines that resemble a corduroy or vinyl record-like appearance, streaking, pinhole defects, line deletion, dot deletion, patch deletion, gloss non-uniformity, etc.

UV curable gel inks are desirable for ink jet printers because they remain in a solid phase at room temperature during shipping and have long term storage capabilities, among other reasons. In addition, problems associated with nozzle clogging as a result of ink evaporation with liquid ink jet inks are largely eliminated with UV curable gel inks, thereby improving the reliability of the ink jet printing. Furthermore, in phase change ink jet printers wherein the ink droplets are applied directly onto the final recording substrate (such as, for example, paper, transparency material, and the like), the droplets solidify immediately upon contact with the substrate, so that migration of ink along the printing medium is prevented and dot quality is improved.

Nevertheless, gel inks require some type of transformation such as curing to prevent them from running or smearing when printed onto a substrate and subjected to general handling. In addition, uncured gel inks stick to roller surfaces in print paths, making them unsuitable for many printing applications without some sort of transformation or curing.

The aforementioned image defects are often caused by an uneven distribution of ink in an image area in which the image should be smooth and uniform. Because the ink temperature drops after ejection, the ink freezes on contact with the substrate and an uneven distribution of ink on the image substrate may occur. The human eye can sometimes observe the uneven distribution as bands or lines in the direction of the substrate travel past the print head, missing portions of the image, or gloss-related defects, for example. This uneven distribution might be addressed by leveling the ink on the image substrate with a contact member, such as a roller, belt, or wiper, in an effort to normalize the ink distribution. Leveling also enables uniform gloss appearance for better image quality, and facilitates line growth to compensate for missing or weak jetting.

Gel inks have very little cohesive strength prior to curing. In addition, gel inks are typically designed to have good affinity to many different types of materials. What this means is that that conventional methods for flattening a layer of ink tend to fail with respect to gel inks, because the gel ink splits. As the splitting occurs, the gel ink leaves a significant portion of the image behind on the device that is trying to flatten it, such as a traditional fuser roll typically used in xerography processes.

SUMMARY

Therefore, there is a need to level a printed image to reduce or eliminate image defects caused by the use of UV gel inks while preventing offset to a leveling member.

According to one embodiment, an apparatus useful in printing comprises a contact leveling member configured to level an image applied to a media substrate. The contact leveling member comprises at least one textured surface configured to repel one or more inks.

According to another embodiment, a method for leveling an image applied to a media substrate comprises causing, at least in part, a contact leveling member that comprises at least one textured surface configured to repel one or more inks to level the image applied to the media substrate.

According to another embodiment, a method for manufacturing a contact leveling member useful in printing having at least one superoleophobic surface comprises causing, at least in part, one or more surfaces of the contact leveling member to be textured by way of one or more of sputtering and photolithography. According to the method, the at least one textured surface is configured to cause, at least in part, the at least one textured surface to have a contact angle greater than 100° and a sliding angle less than 30° when the at least one textured surface contacts the one or more inks.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method and apparatus for leveling a printed image are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the term "micro/nano structure" refers to a structure formed on a surface by any means or material having dimensions of any type on the order of 100 nm to 20 μm, for example.

As used herein, the term "textured surface" refers to a surface populated with any number of types of micro/nano structures, or sputtered with a coating to give the surface a particular roughness other than an inherent roughness of the surface without the coating.

As used herein, the term "pillar" refers to a type of micro/nano structure that looks like a column, for example. A pillar may be three-dimensional rising from a surface and be of any shape in cross-section.

As used herein, the term "groove" refers to a type of micro/nano structure or series of micro/nano structures that comprise a spacing between portions of the micro/nano structure or series of at least two micro/nano structures such that the spacing has a length less than or equal to a length of the surface.

As used herein, the term "re-entrant structure" refers to an overhanging structure that extends from a surface of a micro/nano structure over any spacing between one micro/nano structure and another micro/nano structure.

As used herein, the term "contact angle" refers to an angle at which a liquid meets a surface. For example, consider a liquid droplet at rest on a flat surface. In a cross-sectional view, an angle formed by the surface and a tangent line to a surface of the liquid droplet is the contact angle.

As used herein, the term "sliding angle" refers to the tilting angle of a surface when a liquid droplet starts sliding downward.

Figure 1:
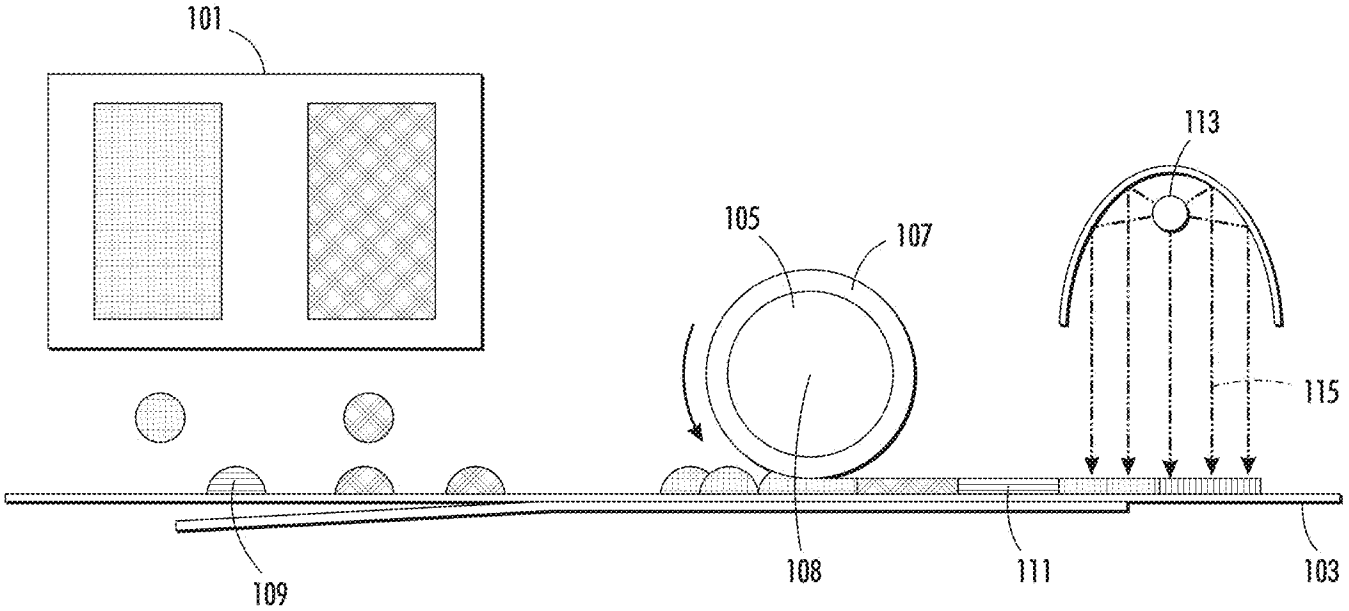
FIG. 1 is a diagram of a system capable of leveling a printed image, according to one embodiment.

FIG. 1 is a diagram of a system capable of leveling a printed image to reduce or eliminate image quality defects on a substrate while preventing offset to a leveling member, according to one embodiment. Conventional printing processes that use UV curable gel inks often result in various image related defects such as, but not limited to, lines that resemble a corduroy or vinyl record-like appearance, streaking, pin-hole defects, line deletion, dot deletion, patch deletion, gloss non-uniformity, etc. Additionally, such defects may be further noticeable if, for example, one or more inkjets that apply an image onto a substrate malfunction or are missing, thereby leaving a gap in a printed image.

One proposed solution to address the above-mentioned defects that may be noticeable because of the use of UV curable gel inks, regardless of how they are caused, includes contact leveling the image to smooth the image and mask the image defects. Contact leveling may be conducted, for example, by mechanically applying a pressure by way of a roller, belt, or press pad, for example, to the substrate having the image. However, physically contacting the printed image often results in other image defects that are alternatively caused, or are in addition to, the image defects discussed above. For example, some of the image may offset to the contact leveling member, thereby affecting the image and/or finish of the image. For example, gloss non-uniformities, potential re-transfer of an image may occur causing a ghost image, color density may be affected by not having enough pigment, etc.

Another proposed solution for mitigating image defects suggests reflowing any inks that are used to form the printed image to allow the image to level after the image has been applied to the substrate. But, such reflowing often results in causing pin-hole-like defects to occur on the image. Applying a flood coat after the printing of the image is complete is another option. However, while the flood coat fills the valleys in the corduroy-like image defects and provides a more uniform appearance, the flood coating technique often causes an undesirable higher gloss. Additionally, a print system that is configured to apply a flood coat is more complex than alternative systems, and consequently, costs more to build and to operate. Further, a flood coat does not mask missing inkjets in addition to the above discussed potential gloss non-uniformities.

To address these problems, a system 100 of FIG. 1 introduces the capability to level a printed image applied to a substrate to reduce or eliminate various image defects without causing additional defects and/or pin-hole-like defects while preventing offset of the image to a leveling member, as discussed above. The system 100 provides a means for a printed image without introducing additional image defects while avoiding offset of the image by implementing a contact leveling member that is configured to be ink phobic. That is, when the contact leveling member is caused to level an image, the contact leveling member will repel the ink image and experience very little, if any, offset of any inks that form the image.

UV curable gel inks are typically made of organic acrylic materials, an as such, behave like oil. Accordingly, to be ink phobic, a surface of the contact leveling member should be superoleophobic. A superoleophobic surface repel oil and grease.

As shown in FIG. 1, the system 100 comprises a print station 101 that applies an image to a substrate 103 by way of inkjet printing, for example. The substrate 103 is shown as a webbed substrate having two surfaces upon which an image may be printed, but it should be noted that the substrate 103 may be any form such as a sheeted substrate, and have any number of sides. The system 100 also comprises a contact leveling member 105 having a superoleophobic surface 107 that may be imposed onto a body 108 of the contact leveling member 105 or separately fabricated as a substrate and applied to the body 108 of the contact leveling member 105.

According to various embodiments, though illustrated in FIG. 1 as a roller or drum, the contact leveling member 105 may alternatively be embodied as a belt having the superoleophobic surface 107 either imposed to the belt itself, or separately applied as an added surface to the belt just like the substrate and body 108 discussed above.

According to various embodiments, the superoleophobic surface 107 features one or more surface textures and may be treated with a surface coating such as a self-assembled fluorosilane layer synthesized from, but not limited to, tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,2,2,2-tetrahydrooctyltrichlorosilane, heptadecafluoro-1,1,2,2-tetrahydrooctyltrimethoxysilane, heptadecafluoro-1,1,2,2-tetrahydrooctyltriethoxysilane, or a combination thereof, and the like, using the molecular vapor deposition technique or the solution coating technique. In one or more embodiments, the one or more surface textures may be formed from one or more micro/nano structures such as pillars, grooves, etc., or any combination thereof.

According to various embodiments, the superoleophobic surface 107 comprises one or more surface textures and may be solution coated with an oleophobic fluoropolymers such as AF1600 and AF2400 manufactured by DuPont, for example, or a perfluoropolyether polymer such Fluorolink-D, Fluorolink-E10H or the like manufactured by Solvay Solexis, for example. In one or more embodiments, the one or more surface textures may be formed from one or more micro/nano structures such as pillars, grooves, etc., or any combination thereof.

According to various embodiments, the one or more micro/nano structures may be formed by way of photolithography and etching techniques, for example, such as an overhanging re-entrant structure formed onto the body 108 of the contact leveling member 105 or onto a substrate is applied to the body 108 to form the superoleophobic surface 107. According to various embodiments, the substrate and/or the body 108 upon which the superoleophobic surface 107 is formed may be flexible and comprise polyimide, polyethylene naphthalate, polyethylene terephthalate, stainless steel, silicon, etc., or any combination thereof, for example. According to various embodiments, because the substrate upon which the superoleophobic surface 107 may be formed is flexible, a substrate having the superoleophobic surface 107 may be processed using a roll-to-roll process to impose any texturing to form the superoleophobic surface 107.

As discussed above, the contact leveling member 105 is configured to level an image applied to a substrate 103. For example, the print station 101 applies ink droplets 109 onto the substrate 103 to form an image. As discussed above, the image formed from ink droplets 109 should be leveled to the substrate 103 to mitigate any image defects such as the various defects discussed above or defects caused by a missing inkjet. The contact leveling member 105, is caused to contact the image applied to the substrate 103, when it levels the image formed from ink droplets 109 to the substrate 103. The contact leveling member 105, when it contacts the image applied to the substrate 103, experiences very little, if any, offset of the image to the superoleophobic surface 107. Once the image formed by ink droplets 109 are leveled, a leveled image 111 is caused to be finally cured by ultraviolet (UV) light, for example, shined onto the leveled image 111 by a UV light source 113 configured to shine ultraviolet light 115 onto the leveled image 111.

The superoleophobic surface 107 has superoleophobic properties because the superoleophobic surface 107 has at least one textured surface, as discussed above. The at least one textured surface causes the superoleophobic surface 107 to have properties such as contact angle greater than 100° with water, oil (hexadecane) and UV ink, for example, and a sliding angle less than 30° for water, oil and UV ink when the superoleophobic surface 107 contacts any of water, oil or UV ink. In one or more embodiments, the superoleophobic surface 107, may have differing geometries that affect contact angle and sliding angle performance, as well as different coatings. For example, consider Table 1-1 which shows sample performances of a superoleophobic surface 107 having one or more pillars and a superoleophobic surface 107 having a grooved surface finish upon which ~10 μl of testing liquids used for tilting angle measurements. The example illustrated in Table 1-1 also shows results for superoleophobic surfaces coated with a self-assembled fluorosilane layer from tridecafluoro-1,1,2,2-tetrahydrooctyltrichlorosilane(FOTS).

TABLE 1-1

| | | Water | | Hexadecane | | UV ink | |
|---|---|---|---|---|---|---|---|
| Geometry | Coating | Contact angle | Sliding angle | Contact angle | Sliding angle | Contact angle | Sliding angle |
| Superolephobic Pillar Surface | Textured surface with FOTS | 156.2° | 10.1° | 157.9° | 9.8° | 146.1° | 9.8° |
| Superolephobic Grooved Surface Parallel to the groove direction | Textured surface with FOTS | 131.3° | 7.5° | 113.2° | 4.1° | — | — |

Contact angle and sliding angle are key indicators for the oleophobicity of surface 107. A high contact angle indicates high repellency and low wettability by a test droplet of liquid (water, hexadecane, UV ink), whereas a low sliding angle indicates low surface adhesion between the test droplet of liquid and the surface 107.

Comparatively, conventional low surface energy contact levelling surfaces comprising Teflon®, Perfluoroalkoxy (PFA) film, and/or Cytop, for example, are actually oleophilic. The oleophilicity of these materials are indicated by moderate wettability and high adhesion for UV ink. The wettability and high adhesion of UV ink leads to substantial ink offset to a contact leveling surface having any conventional surface. For example, Teflon® has performance characteristics such as those illustrated in Table 2-1 below.

TABLE 2-1

| | Water | | Hexadecane | | UV ink | |
|---|---|---|---|---|---|---|
| Coating | Contact angle | Sliding angle | Contact angle | Sliding angle | Contact angle | Sliding angle |
| PTFE Film | 117.7° | 64.3° | 48.0° | 33.1° | 58.4° | 25.4° |

Not surprisingly, Teflon-like coated contact leveling surfaces show high UV ink offset and fail to provide sufficient contact leveling (most likely because some of the image is transposed from the substrate to a conventional contact leveling surface via offset). Because the superoleophobic surface 107 is better suited for preventing ink offset than a conventional contact leveling surface, as illustrated above, the use of the superoleophobic surface 107 enables robust and reliable image conditioning, leveling.

To facilitate the superoleophobicity, the superoleophobic surface 107, as discussed above, may be fabricated by first sputtering an amorphous silicon layer on a substrate, followed by texturing the surface by photolithography and etching to create the one or more micro/nano structures, and then coating the textured surface with a conformal surface treatment.

According to various embodiments, the one or more micro/nano structures may take many forms such as, but not limited to, pillars, grooves, or any combination thereof. The one or more micro/nano structures, if formed as pillars, for example, may have any shape in cross-section such as, but not limited to, a circle, ellipse, triangle, rectangle, square, octagon, hexagon, any other polygon, or freeform, for example, and may be the same, or any combination of shapes as imposed onto the body 108 of the contact leveling member 105, or the substrate upon which the superoleophobic surface 107 is imposed. Additionally any of the pillars, grooves, etc., may have, for example, one or more lips that are re-entrance structures having a greater dimension in cross-section than other portions of the microstructure. For example, a pillar may from a side view, look like a nail having a head and a shaft.

According to various embodiments, one or more side surfaces of the one or more micro/nano structures may be any of smooth, wavy, ribbed, and the like. For example, if the side surface is wavy, the wavy structure may be on the order of about 200 nm. The superoleophobic surface 107 may have micro/nano structures such as, for example, pillars of 100 nm to 10 μm in diameter and 100 nm to 10 μm in height with center-to-center spacing of 100 nm to 10 μm, grooves of 100 nm to 10 μm in width and 100 nm to 10 μm in height with center-to-center spacing of 100 nm to 12 μm, as well as any variable length, or any combination thereof. The magnitude of the micro/nano structures and any spacing therebetween may be based, at least in part, on the ink that may be applied to the substrate 103.

Figure 2:
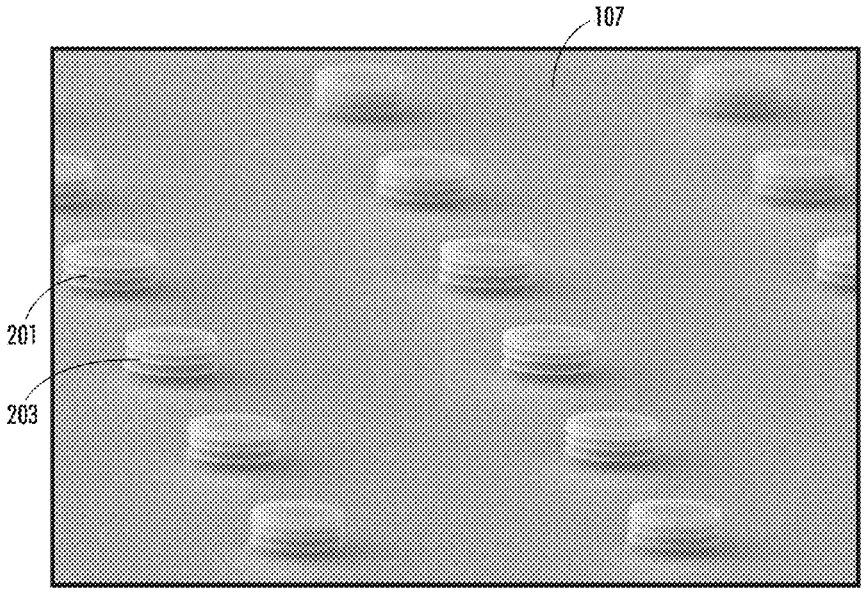
FIG. 2 is a diagram of pillar-like micro/nano structures, according to one embodiment.

FIG. 2 is a diagram of a superoleophobic surface 107 having multiple micro/nano structures that are embodied as pillars 201. In this example embodiment, the pillars 201 are circular in cross-section and have a wavy side structure 203. In alternative embodiments, some or all of the pillars 201 may have a smooth side structure or a re-entrant structure. As discussed above, the pillars 201 may be, for example, 100 nm to 10 μm in width and 100 nm to 10 μm in height with center-to-center spacing of 100 nm to 12 μm.

Figure 3:
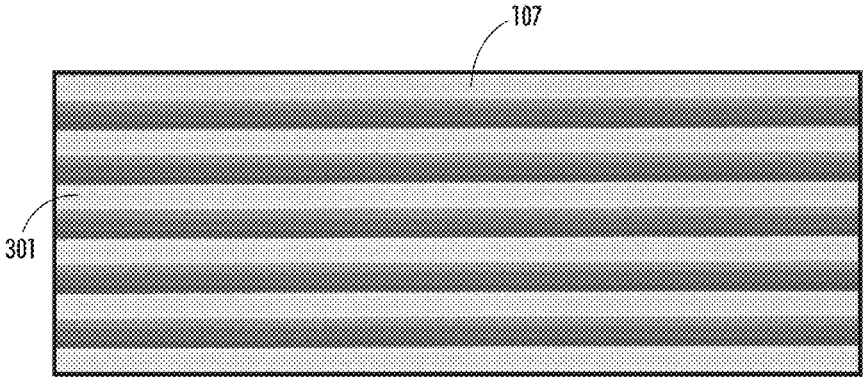
FIG. 3 is a diagram of groove-like micro/nano structures, according to one embodiment.

FIG. 3 is a diagram of a superoleophobic surface 107 having multiple micro/nano structures that are embodied as grooves 301. In this example embodiment, the grooves 301 are illustrated as traversing an entire width or length of the superoleophobic surface 107. According to various embodiments, however, the length and direction of the grooves may vary and be in any direction. In one or more embodiments, the grooves 301, as discussed above, may have any combination of wavy side structures similar to side structures 203 discussed above in FIG. 2, smooth side structures, and/or one or more a re-entrant structures. Additionally, as discussed above, the grooves 301 may be, for example, 100 nm to 10 μm in width and 100 nm to 10 μm in height with center-to-center spacing of 100 nm to 12 μm, and be any variable length.

It should be noted that, while FIG. 2 illustrates micro/nano structures that are pillars 201 and FIG. 3 illustrates micro/nano structures that are grooves 301, the superoleophobic surface 107 may be populated with any combination of pillars 201 and/or grooves 301, and/or any other micro/nano structure geometry discussed above, all having the same or varying dimensions and/or spacing, as well as any varying combination of side structures such as wavy side structures 203, discussed above.

Figure 4:
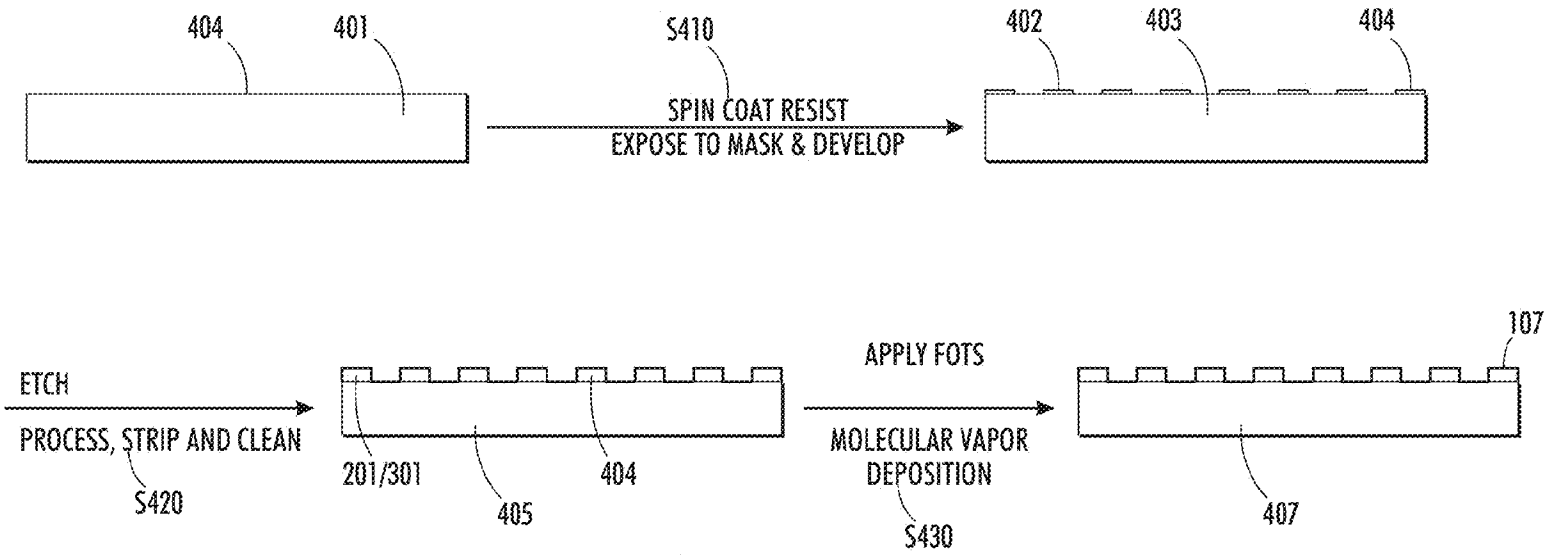
FIG. 4 is a diagram of a process for forming a textured surface, according to one embodiment.

FIG. 4 illustrates an example process for imposing a superoleophobic surface 107 to a blank substrate 401. In this example, the blank substrate 401 may correspond to the body 108 discussed above, or to a substrate that may have a textured surface imposed upon it such that the substrate is later applied to the body 108. The blank substrate 401 may be flexible and comprise an amorphous silicon layer deposited on polyimide, polyethylene naphthalate, polyethylene terephthalate, stainless steel, etc., or any combination thereof, for example. In step S410, the blank substrate 401 is coated with photo resist 402 and the blank substrate 401 is exposed to a mask and developed to cause, for example, developed substrate 403. The developed substrate 403 has photo resist 402 applied at particular locations on a surface 404 that are in accordance with a pattern supplied by the mask to which the blank substrate 401 is exposed. The pattern supplied by the mask, accordingly, provides a pattern for any microstructures that are to be imposed on the blank substrate 401 to provide texturing so as to impose superoleophobicity to the surface 404 of the blank substrate 401.

The process continues to step S420 in which the developed substrate 403 is etched using any etching process such as, for example, a Bosch etching process, or any other etching technique, stripped and cleaned resulting in textured substrate 405. This example, the textured substrate 405 has pillars and/or grooves such as pillars 201 and grooves 301, discussed above imposed to the surface 404. Next, in step S430, the textured substrate 405 is coated with POTS by, for example, a molecular vapor deposition process to result in superoleophobic substrate 407 having the superoleophobic surface 107 discussed above. The resulting micro/nano structures 201/301, for example, formed in this embodiment have wavy side walls, as discussed above. According to various embodiments, the blank substrate 401 may be provided and processed in sheeted or roll to roll form, for example.

Figure 5:
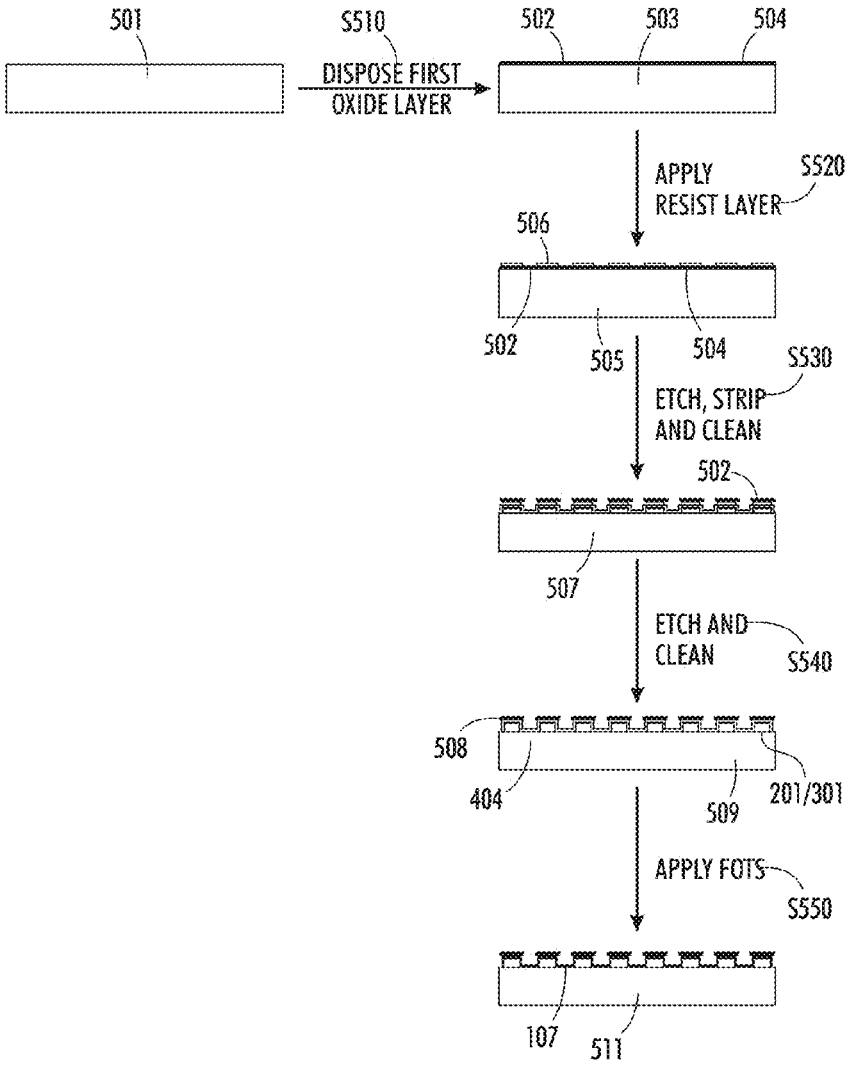
FIG. 5 is a diagram of a process for forming a multi-resist layered textured surface, according to one embodiment.

FIG. 5 illustrates an example process for imposing a superoleophobic surface 107 to a blank substrate 501. In this example, the blank substrate 501 may correspond to the body 108 discussed above, or to a substrate that may have a textured surface imposed upon it such that the substrate is later applied to the body 108. A superoleophobic surface 107, according to this example embodiment, has one or more re-entrant structures that are part of any micro/nano structures are imposed onto a blank substrate 501. The blank substrate 501 may be flexible and comprise an amorphous silicon layer deposited on polyimide, polyethylene naphthalate, polyethylene terephthalate, stainless steel, etc., or any combination thereof, for example. In step S510, the blank substrate 501 can have disposed a thin silicon oxide layer 502, such as via plasma enhanced chemical vapor deposition or low pressure chemical vapor deposition to cause, for example, silicon oxide deposited substrate 503. The silicon oxide deposited substrate 503 has the silicon oxide layer 502 applied on a surface 504. Then, in step S520, a photo resist 506 is applied to the silicon oxide deposited substrate 503, exposed to a mask and developed to cause, a textured pattern in the photo resist coated substrate 505 that has a photo resist 506 applied at locations on the surface 504 that are in accordance with a pattern supplied by the mask. The pattern supplied by the mask, accordingly, provides a pattern for any micro/nano structures that are to be imposed on the blank substrate 501 to provide texturing so as to impose superoleophobicity to the surface 504 of the blank substrate 501.

The process continues to step S530 in which the photo resist coated substrate 505 is etched using fluorine based reactive ion etching ($CH_3F/O_2$), stripped and cleaned resulting in a patterned silicon oxide layer 503 on substrate 507. Next, in step S540 the substrate 507 is further etched by a second fluorine based ($SF_6/O_2$) reactive ion etching process, followed by hot stripping, and piranha cleaning to create the textured micro/nano structures 201/301 having overhang re-entrant structures 508 to result in the textured substrate 509. Optionally, a Xenon difluoride isotropic etching process can be applied to enhance the degree of overhang on textured micro/nano structures 201/301 (not shown in FIG. 5), $XeF_2$ vapor phase etching exhibits nearly infinite selectivity of silicon to silicon dioxide which is the cap material. Then, in step S550 the textured substrate 509 is coated with FOTS by, for example, a molecular vapor deposition process to result in superoleophobic substrate 511 having the superoleophobic surface 107 discussed above with re-entrant structures 508. The resulting micro/nano structures 201/301 formed in this embodiment have straight sidewalls that may be smooth with a re-entrant structure 508, as discussed above. According to various embodiments, the blank substrate 501 may be provided and processed in sheeted or roll to roll form, for example.

Figure 6:
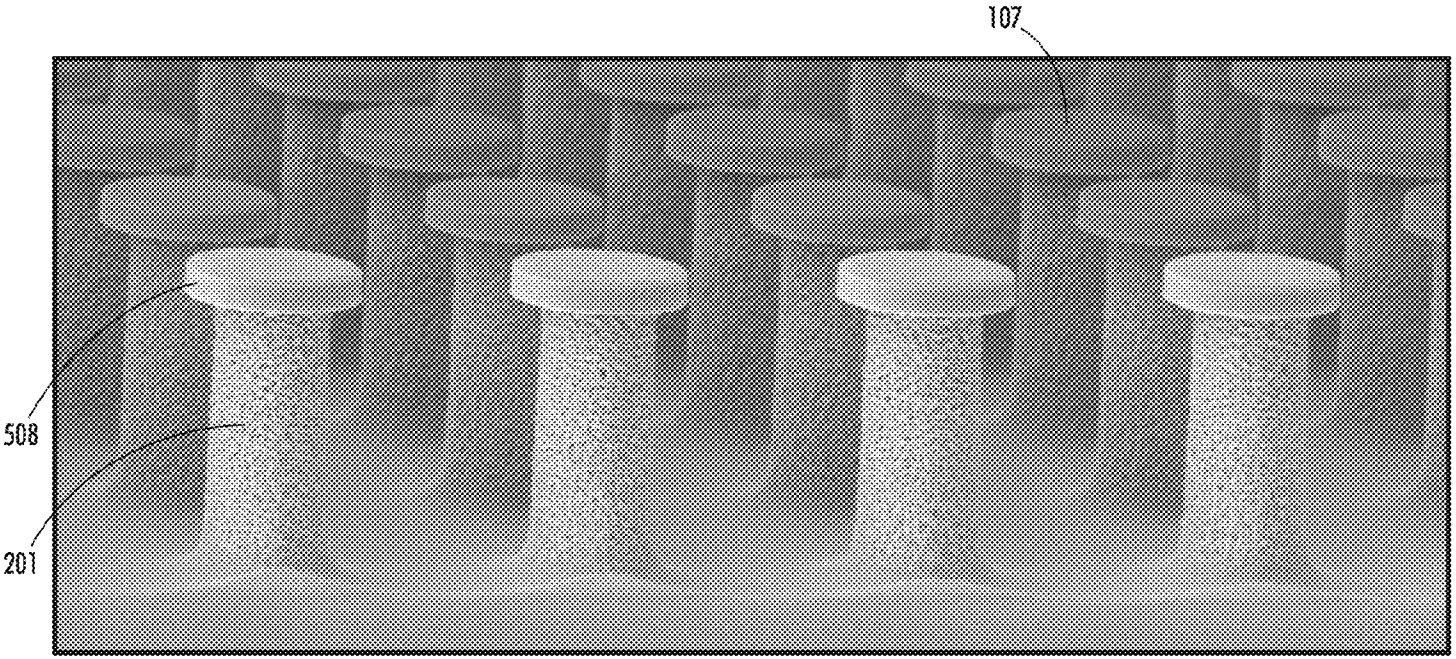
FIG. 6 is a diagram of pillar-like micro/nano structures having re-entrant structures, according to one embodiment.

FIG. 6 illustrates a diagram of a superoleophobic surface 107 having multiple micro/nano structures that are embodied as pillars 201 having re-entrant structures 508 discussed above. In this example embodiment, the pillars 201 are circular in cross-section and may have a wavy or smooth side structure. In alternative embodiments, the pillars may be replaced wholly or partially by grooves 301 discussed above and have re-entrant structures 508. As discussed above, the pillars 201 may be, for example, 100 nm to 10 μm in width and 100 nm to 10 μm in height with center-to-center spacing of 100 nm to 12 μm. The re-entrant structures 508 may, for example be any dimension greater than the 100 nm to 10 μm width of the pillars 201.

Figure 7:
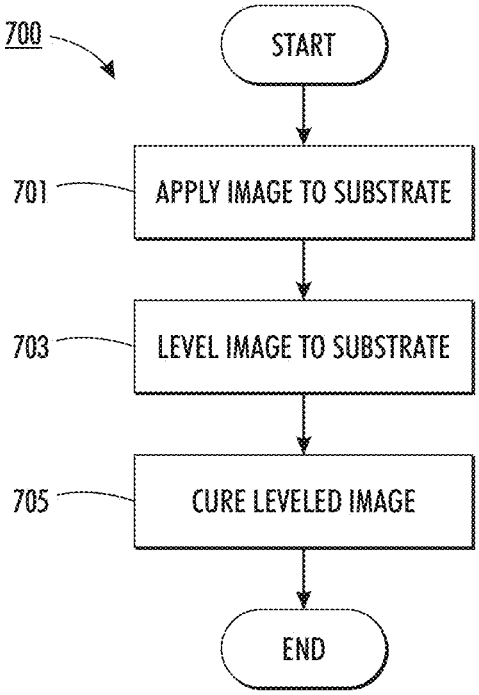
FIG. 7 is a flowchart of a method of leveling a printed image, according to one embodiment.

FIG. 7 is a flowchart of a process for leveling a printed image to reduce or eliminate image defects, while preventing image offset, according to one embodiment In step 701, an image is applied to a media substrate such as substrate 103 discussed above.

Then, in step 703, a contact leveling member comprising at least one textured surface configured to repel one or more inks is caused to level the image applied to the media substrate. As discussed above, the at least one textured surface may have one or more micro/nano structures configured to cause, at least in part, the at least one textured surface to have a contact angle greater than 100° and a sliding angle less than 30° when the at least one textured surface contacts the one or more inks. Additionally, the one or more micro/nano structures may be any of one or more pillars, one or more grooves, one or more pyramids, or any combination thereof. In one or more embodiments, the contact leveling member comprises a body and the at least one textured surface is formed on a substrate applied to the body. Alternatively, the at least one textured surface may be imposed on the body itself. The process continues to step 705 in which the leveled image is cured.

The processes described herein for leveling a printed image to reduce or eliminate image defects may be advantageously implemented via software, hardware, firmware or a combination of software and/or firmware and/or hardware. For example, the processes described herein, may be advantageously implemented via processor(s). Digital Signal Processing (DSP) chip, an Application Specific Integrated Circuit (ASIC), Field Programmable Gate Arrays (FPGAs), etc.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. An apparatus used in printing comprising:

a contact leveling member configured to level an image applied to a media substrate, the contact leveling member comprising at least one textured surface configured to repel one or more inks;

wherein the at least one textured surface comprises one or more micro/nano structures configured to cause, at least in part, the at least one textured surface to have an ink contact angle greater than 100° and a sliding angle less than 30° when the at least one textured surface contacts the one or more inks;

wherein the at least one textured surface comprises one or more of an array of pillars, an array of pillars having one or more overhang re-entrant structures, and an array of pillars having textured sidewalls, the term "re-entrant structure" referring to an overhanging structure that extends from a surface of a micro/nano structure over any spacing between one micro/nano structure and another micro/nano structure.

2. An apparatus of claim 1, wherein the one or more micro/nano structures comprise an array of pillars having a pillar height of about 100 nm to about 10 micrometers.

3. An apparatus of claim 1, wherein the at least one textured surface comprises an array of pillars having a pillar diameter of about 100 nm to about 10 micrometers and having a center-to-center distance of about 100 nm to about 12 micrometers.

4. An apparatus of claim 1, wherein the one or more micro/nano structures form one or more groove patterns, one or more groove patterns including one or more overhang re-entrant structures, and one or more groove patterns having textured sidewalls.

5. An apparatus of claim 4, wherein the one or more micro/nano structures that form the one or more groove patterns have a height of about 100 nm to about 10 micrometers.

6. An apparatus of claim 4, wherein the one or more micro/nano structures that form the one or more groove patterns have a width of about 100 nm to about 10 micrometers and a center-to-center distance of about 100 nm to about 12 micrometers.

7. An apparatus of claim 1, wherein the one or more micro/nano structures comprise one or more re-entrant structures.

8. An apparatus of claim 1, wherein the one or more micro/nano structures are formed by one or more of light lithography and an e-beam technique.

9. An apparatus of claim 1, wherein the contact leveling member comprises a body and the at least one textured surface is formed on a substrate applied to the body.

10. An apparatus of claim 1, wherein the at least one textured surface comprises one or more fluorosilane layers synthesized from one or more of tridecafluoro-1,1,2,2-tetrahydrooctyltrichlorosilane, tridecafluoro-1,1,2,2-tetrahydrooctyltrimethoxysilane, tridecafluoro-1,1,2,2-tetrahydrooctyltriethoxysilane, heptadecafluoro-1,1,2,2-tetrahydrooctyltrichlorosilane, heptadecafluoro-1,1,2,2-tetrahydrooctyltrimethoxysilane, and heptadecafluoro-1,1,2,2-tetrahydrooctyltriethoxysilane.

11. An apparatus of claim 1, wherein the at least one textured surface comprises one or more of silicon and a coating comprising one or more of an oleophobic fluoropolymer and a perfluoropolyether polymer.

* * * * *